US008569222B2

(12) United States Patent
Hutmacher et al.

(10) Patent No.: US 8,569,222 B2
(45) Date of Patent: Oct. 29, 2013

(54) LAUNDRY ARTICLE HAVING CLEANING PROPERTIES

(71) Applicant: Henkel AG & Co. KGaA, Duesseldorf (DE)

(72) Inventors: Martina Hutmacher, Duesseldorf (DE); Peter Schmiedel, Duesseldorf (DE); Matthias Sunder, Duesseldorf (DE); Ulrich Pegelow, Duesseldorf (DE); Timothy O'Connell, Duesseldorf (DE); Thomas Weber, Dormagen (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 13/655,629

(22) Filed: Oct. 19, 2012

(65) Prior Publication Data

US 2013/0045911 A1 Feb. 21, 2013

Related U.S. Application Data

(63) Continuation of application No. PCT/EP2011/056026, filed on Apr. 15, 2011.

(30) Foreign Application Priority Data

Apr. 20, 2010 (EP) ..... 10160416

(51) Int. Cl.

| | |
|---|---|
| ***C11D 17/04*** | (2006.01) |
| ***C11D 3/386*** | (2006.01) |
| ***C11D 3/00*** | (2006.01) |
| ***D06L 1/00*** | (2006.01) |

(52) U.S. Cl.
USPC ..... 510/295; 510/276; 510/320; 510/392; 510/438; 510/439; 8/137

(58) Field of Classification Search
USPC ..... 510/276, 295, 320, 392, 438, 439; 8/137
See application file for complete search history.

(56) References Cited

U.S. PATENT DOCUMENTS

| | | | | |
|---|---|---|---|---|
| 5,077,119 | A * | 12/1991 | Wraige | 510/518 |
| 6,130,193 | A * | 10/2000 | Gillette | 510/295 |
| 6,673,763 | B1 | 1/2004 | Hansen et al. | |
| 2004/0266650 | A1 | 12/2004 | Lambotte et al. | |
| 2007/0111920 | A1 | 5/2007 | Baur et al. | |

FOREIGN PATENT DOCUMENTS

| | | | |
|---|---|---|---|
| EP | 0099197 | A2 | 1/1984 |
| JP | 2005206633 | A | 8/2005 |
| WO | 2007120867 | A2 | 10/2007 |

OTHER PUBLICATIONS

PCT International Search Report (PCT/EP2011/056026) dated Mar. 8, 2011.
Database WPI, Week 200556, Thomson Scientific, London, GB, Accessed Sep. 8, 2011.

* cited by examiner

*Primary Examiner* — Lorna M Douyon
(74) *Attorney, Agent, or Firm* — David K. Benson

(57) ABSTRACT

A laundry article used for cleaning fabrics includes a water-insoluble nonwoven substrate and coated thereon into at least one zone each a detergent composition and an enzyme-containing composition. The enzyme-containing composition comprises an enzyme embedded in a matrix.

10 Claims, No Drawings

LAUNDRY ARTICLE HAVING CLEANING PROPERTIES

FIELD OF THE INVENTION

The present invention generally relates to an article of manufacture used for cleaning fabrics. More specifically the article comprises a water-insoluble substrate coated with detergent and enzymes. The invention also relates to a method of manufacturing and to a method of using such articles.

BACKGROUND OF THE INVENTION

Laundry detergents are available in several different product formats like powders, granulates, liquids, gels or unit dose items such as tablets or pouches. Unit dose items particularly comply with the consumers' desires for simplified dosage. But, laundry tablets and pouches exhibit a few drawbacks. For example, tablets experience a delay in their dissolution in water due to their high densification and thus, a delay in their release of the important ingredients. In order to improve dissolution rates without being detrimental to tablet strength, several technical solutions have been found such as the use of disintegration aids. However, tables with disintegration aids are complex and have relatively high manufacturing costs since disintegration aids usually do not show further cleaning or conditioning properties.

The disadvantage of pouches that include liquid detergent is that incompatible ingredients cannot be formulated in one detergent. Additionally, a conventional wrapping material such as polyvinyl alcohol may not dissolute completely during the washing process and residues can be found on the fabrics.

Another alternative unit dose item is a water-insoluble substrate that is coated with laundry detergent. The laundry article is added together with the laundry to the washing machine. During the washing process the coating dissolves and thereby releases its ingredients to the wash liquor.

WO 07/1 20867 A2 discloses a laundry article that functions as a single product for washing and conditioning fabrics when added to the washing machine and then carried along with the wet clothes into the clothes dryer. The laundry article comprises a water-insoluble substrate onto which a minimum of two compositions is applied in "zones." The water-insoluble substrate for the laundry article of the present invention is coated with a detergent composition and a fabric conditioning composition. In order to manufacture such a laundry article preferably a heated molten mixture of the particular compositions is coated onto the water-insoluble substrate.

Proteins, fats and starch often form constituents of persistent stains. In order to improve removal of such stains enzymes are commonly used in laundry detergents.

Especially due to high temperatures (70° C. to 80° C.) during the manufacturing process of such laundry articles enzymes cannot be present in the molten mixture of a detergent compositions since enzymes are sensitive to temperature. Another problem constitutes the high pH of the detergent compositions that is detrimental to enzyme stability.

It is an object of the present invention to provide a laundry article comprising a water-insoluble substrate coated with a detergent composition and an enzyme-containing composition.

Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A laundry article used for cleaning fabrics comprising a water-insoluble nonwoven substrate; a detergent composition solidified on the substrate in at least one zone; and, an enzyme-containing composition solidified on the substrate in at least one zone, wherein the enzyme-containing composition comprises an enzyme embedded in a matrix and wherein the matrix is composed of fatty acids, fatty acid soaps, polyols and mixtures thereof.

A method of producing a laundry article laundry article used for cleaning fabrics comprising a water-insoluble nonwoven substrate, a detergent composition and an enzyme-containing composition comprising the steps of melting a detergent composition, melting a matrix material comprising, adding an enzyme to the molten matrix material, supplying a length of nonwoven substrate, and coating said substrate with both the molten detergent composition and the molten enzyme-containing composition into at least one zone each and allowing the resulting detergent and enzyme-containing composition zones to cool and solidify on the substrate.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

The above objects are achieved by a laundry article used for cleaning fabrics comprising:

a. a water-insoluble nonwoven substrate;
b. a detergent composition solidified on the substrate in at least one zone; and,
c. an enzyme-containing composition solidified on the substrate in at least one zone, wherein the enzyme-containing composition comprises an enzyme embedded in a matrix and wherein the matrix is composed of fatty acids, fatty acid soaps, polyols and mixtures thereof.

It has surprisingly been found that the use of fatty acids, fatty acid soaps, polyols and mixtures thereof as matrix material for enzyme-containing compositions leads to a laundry article with good cleaning properties, especially with regard to enzyme specific stains.

A matrix made of fatty acids, fatty acid soaps, polyols and mixtures thereof only shows little water absorption during storage, even when stored at 35° C. and a humidity of 80%. The melting point of such a matrix can be easily adjusted to 50 to 60° C., so that the enzymes are not detonated during the manufacturing process. The same holds true for the pH of the matrix that can be adjusted to the need of he particular enzyme or enzyme mixture. Additionally, the enzyme-containing composition shows good water solubility so that the enzymes are quickly and completely released during the washing process.

In a preferred embodiment of the invention the matrix is at a level from 50% by weight to 99.9% by weight of the enzyme-containing composition and more preferred from 85% by weight to 99.5% by weight of the enzyme-containing composition.

In another preferred embodiment of the invention the enzyme is at a level from 0.1% by weight to 50% by weight of the enzyme-containing composition and more preferred from 0.5% by weight to 15% by weight of the enzyme-containing composition.

Furthermore, it is preferred that the enzyme-containing composition additionally comprises an enzyme stabilizer.

It is preferred that the polyol is selected from group consisting of polyethylene glycol, polypropylene glycol, glycerin, sucrose, propylene glycol, sorbitol, glucose and mixtures thereof. These polyols are commercially available.

Additionally, it is preferred that the fatty acid is selected from caprylic acid, capric acid, lauric acid, myristic acid, palmitic acid, stearic acid, (hydrogenated) erucaic acid, linoleic acid, linolenic acid, oleic acid, (hydrogenated) behenic acid, coconut fatty acid, palm kernel fatty acid, olive oil fatty acid, and tallow fatty acid. These fatty acids have already been used in the laundry industry for a long time.

If the matrix comprises a fatty acid soap, it is preferred that the fatty acid soap is selected from the metal salts and ammonium salts of caprylic acid, capric acid, lauric acid, myristic acid, palmitic acid, stearic acid, (hydrogenated) erucaic acid, linoleic acid, linolenic acid, oleic acid, (hydrogenated) behenic acid, coconut fatty acid, palm kernel fatty acid, olive oil fatty acid, and tallow fatty acid.

The present invention also relates to a method of producing a laundry article laundry article used for cleaning fabrics comprising a water-insoluble nonwoven substrate, a detergent composition and an enzyme-containing composition comprising the steps of:

a. melting a detergent composition;
b. melting a matrix material comprising;
c. adding an enzyme to the molten matrix material;
d. supplying a length of nonwoven substrate; and,
e. coating said substrate with both the molten detergent composition and the molten enzyme-containing composition into at least one zone each and allowing the resulting detergent and enzyme-containing composition zones to cool and solidify on the substrate.

Additionally, the invention relates to a method of washing fabrics comprising the steps of:

a. supplying the laundry article according to the present invention; and
b. washing a load of fabrics in a laundry machine with said article.

The invention is described in greater detail below on the basis of examples, among other things.

In general, the present invention is a laundry article comprising a water-insoluble substrate onto which a minimum of two compositions is applied in "zones." The laundry article of the present invention comprises a water-insoluble substrate with one zone of detergent composition, plus one zone of enzyme-containing composition, arranged in geographical areas, or patterns or regions, (called "zones"), on the water-insoluble substrate. Optional perforations on the article allow the consumer to break apart the article along defined lines to customize the product for the specific laundering requirements, customizing the amounts and the formulas used for a particular laundry load.

The enzyme-containing composition comprises a matrix and an enzyme embedded in the matrix. The material for the matrix comprises fatty acids, fatty acid soaps, polyols and mixtures thereof.

Suitable enzymes are, in particular, proteases, (poly)esterases, lipases or lipolytically active enzymes, amylases, cellulases, hemicellulases, cutinases, β-glucanases, oxidases, peroxidases, mannanases, tannases, perhydrolases, and/or laccases, and mixtures of the aforesaid enzymes. All these enzymes contribute, in the laundry, to the removal of stains such as protein-, fat-, or starch-containing stains, and graying.

The enzymes are preferably added as liquid formulations.

The enzymes may be protected, particularly during storage, from damage such as for example inactivation, denaturation or degradation for instance due to physical influences, oxidation or proteolytic cleavage. Therefore, the enzyme-containing composition preferably additionally comprises stabilizers for this purpose. Suitable stabilizers comprise for example benzamidine hydrochloride, borax, boric acids, boronic acids, boronic acid salts, boronic acid esters, 4-formylphenyl boronic acid, peptide aldehydes, aliphatic carboxylic acids, butylated hydroxytoluene (BHT), butylated hydroxyanisole (BHA), propyl gallate, t-butylhydroquinone, phosphonates, calcium lactate, calcium chloride and sodium formate and amino alcohols. The stabilizers may be incorporated via the liquid enzyme formulations into the enzyme-containing composition. Additionally, polyols, if present as matrix material, serve to stabilize enzymes.

Additionally, liquid enzyme formulations may comprise for example buffer substances.

It is preferred that the matrix comprises fatty acids, fatty acid soaps or polyols as matrix material. It is also preferred that the matrix comprises a mixture of two or three of these materials as matrix material.

Suitable fatty acids include caprylic acid, capric acid, lauric acid, myristic acid, palmitic acid, stearic acid, (hydrogenated) erucaic acid, linoleic acid, linolenic acid, oleic acid, (hydrogenated) behenic acid, coconut fatty acid, palm kernel fatty acid, olive oil fatty acid, or tallow fatty acid.

If the matrix comprises a fatty acid soap, it is preferred that the fatty acid soap is selected from the metal salts and ammonium salts of caprylic acid, capric acid, lauric acid, myristic acid, palmitic acid, stearic acid, (hydrogenated) erucaic acid, linoleic acid, linolenic acid, oleic acid, (hydrogenated) behenic acid, coconut fatty acid, palm kernel fatty acid, olive oil fatty acid, and tallow fatty acid. Preferred metal salts comprise sodium salts, potassium salts, zinc salts or aluminum salts of the above mentioned fatty acids.

Fatty acid soaps comprising at least 16 carbon atoms may also serve as suds compressors.

Suitable polyols are selected from polyethylene glycol, polypropylene glycol, glycerin, sucrose, propylene glycol, sorbitol, glucose and mixtures thereof. In a preferred embodiment the matrix material comprises polyethylene glycol, such as PEG-75, as the only matrix material.

In another preferred embodiment the matrix material comprises a combination of a fatty acid and a non-polymeric polyol such as glycerin, sucrose, propylene glycol, sorbitol, glucose and mixtures thereof. In another preferred embodiment the matrix material comprises fatty acid soap and a non-polymeric polyol such as glycerin, sucrose, propylene glycol, sorbitol, glucose and mixtures thereof. And in still another preferred embodiment the matrix material comprises fatty acid soap, fatty acid and a non-polymeric polyol such as glycerin, sucrose, propylene glycol, sorbitol, glucose and mixtures thereof.

All these matrix materials and combination of matrix materials have proven to be essential matrix ingredients for providing a sufficient firm and water-soluble matrix.

It is preferred that the enzyme-containing compositions exhibits an absorption of water of less than 15% by weight and more preferred less than 5% by weight of the enzyme-containing composition when stored in relative humidity of 80% at 35° C.

In addition to the optional enzyme stabilizer and the optional buffer substances the enzyme-containing composition may additionally contain further additives in an amount of usually up to 20% by weight, preferably 1% to 15% by weight, in particular 2% to 10% by weight of the enzyme-containing composition.

Other suitable further additives may comprise other optional ingredients such as solvents, solubilizers, fragrances, fragrance vehicles, fluorescent agents, dyestuffs, foam inhibitors, silicone oils, anti-redeposition agents, graying inhibitors, shrinkage preventers, antiwrinkle agents, dye transfer inhibitors, antimicrobial active ingredients, germicides, fungicides, antioxidants, corrosion inhibitors, antistatics, ironing aids, phobizing and impregnating agents, swelling and nonslip agents, water and UV absorbers as long as the additives are not detrimental to the stability of the enzyme and to the delivery of the enzyme during the washing process.

It is preferred that enzyme-containing composition additionally contains an enzyme stabilizer. It is also preferred that enzyme-containing composition additionally contains an enzyme stabilizer and a solubilizer such as an anionic and/or nonionic surfactant.

The detergent composition applied to the substrate may comprise anionic surfactant, nonionic surfactant, builder, chelant and further adjuvant ingredients such as but not limited to bleaches, bleach catalysts, bleach activators, fragrances, fragrance vehicles, fluorescent agents, dyestuffs, foam inhibitors, silicone oils, anti-redeposition agents, graying inhibitors, shrinkage preventers, antiwrinkle agents, dye transfer inhibitors, antimicrobial active ingredients, germicides, fungicides, antioxidants, preservatives, corrosion inhibitors, antistatics, and UV absorbers and is preferably a co-melt of mostly anhydrous waxy ingredients (materials normally solids or waxes at ambient temperature), or low-water content slurry or paste. The detergent composition even if a co-melt of waxy ingredients may preferably contain insoluble particles agglomerated into the melt, either for performance or aesthetic reasons.

Additionally, the laundry article of the present invention may comprise further compositions that are applied in further "zones". A preferred further composition is a fabric conditioning composition comprising a quaternary ammonium cationic surfactant.

A variety of quaternary ammonium cationic surfactant may be utilized; however acyclic quaternary surfactants are preferred. For example, useful quaternary synthetic surfactants that are acyclic include linear alkyl, branched alkyl, hydroxyalkyl, oleylalkyl, acyloxyalkyl, diamidoamine, or diester quaternary ammonium compounds. The preferred quaternary surfactants for use in the present invention are waxy solids or are highly viscous at ambient temperature such that the material can be melted and applied hot to the substrate, and these may include traditional tetraalkyl materials or ester quaternaries, or combinations of the two types. It may be preferred that the quaternary ammonium cationic surfactant is a fabric softening agent. It may also be preferred that the quaternary ammonium cationic surfactant is an anti-static agent.

The quaternary ammonium cationic surfactant in accordance with a preferred embodiment is at a level from about 10% to about 80% by weight of the fabric conditioning composition and more preferred from about 25% to about 60% by weight of the fabric conditioning composition.

A variety of materials may be used as the substrate in the present invention. For example the substrate may be natural pulp based paper or cotton materials, entirely synthetic material (such as melt-blow, spun-laid, air-laid or carded/bonded polypropylene, polyester, or similar synthetic polymer fiber substrates) or combinations of natural and synthetic materials (such as pulp wet-laid onto a nonwoven web). For example, any of the substrates used in the "wet-wipes" hard surface and personal cleansing products, dryer sheets, or personal hygiene products currently on the market may be useful as the substrates for the articles of the present invention. Additionally, materials that are found in liquid and air filtration industries may find use as the substrate.

Suitable substrate sheets may be obtained from any number of various water-insoluble nonwoven fabrics. The term "sheet" is used somewhat loosely here and relates to a preferred shape of an individual article of the present invention, that is, a flat sheet, for example square or rectangular, that is much greater in width and length than thickness and is a single laundry article. Thus the term "sheet" is used as a description of a section of nonwoven that may be used for an individual article of the present invention.

Nonwoven fabrics with their multitude of uses are well known to those skilled in the textiles art. Such fabrics can be prepared by forming a web of continuous filament and/or staple fibers and optionally bonding the fibers at fiber-to-fiber contact points to provide fabrics of the required properties. The term "bonded nonwoven fabric" is used to include nonwoven fabrics where a major portion of the fiber-to-fiber bonding is achieved by either thermal fusion of adjacent fibers, or adhesive bonding that is accomplished through incorporation of adhesives in the web to "glue" fibers together, or by other bonding such as obtained by the use of liquid or gaseous bonding agents (usually in conjunction with heating) to render the fibers cohesive. Chemical bonding may be accomplished through the use of adhesive or latex powders dispersed between the fibers in the web, which is then activated by heat, ultraviolet or infrared radiation, or other suitable activation method. Thermally and/or chemically bonded nonwovens may be used as the substrates within the present invention.

Nonwovens may comprise fibers known as "bi-component fibers", for example "sheath/core bi-component fibers", which are fibers having an outer sheath area or layer with a lower melting point than the inner core area, allowing for efficient and controlled thermal bonding through melting of just the outer layer of each fiber. Additionally, multi-component fibers are similarly known and commercially incorporated into nonwovens.

During the bonding of the fibers, the web may be simultaneously subjected to mechanical compression to obtain the desired bonding, weights and thicknesses in a process known as "thermal compression bonding". Mechanical compression may be used to set the loft or thickness of fabrics with similar basis weights. Normally increasing the basis weight, or the mass per square area increases thickness, and increasing bonding and compression decreases loft. Nonwovens with "sidedness" may be preferred for use in the articles of this invention. Sidedness refers to a nonwoven with a difference in density and/or loft on each side. These preferred nonwovens with sidedness may also be described by looking at the internal cross section through the nonwoven. For example, the preferred nonwovens for use herein have at least one "non-uniform cross-section". That is, if the preferred nonwoven with sidedness is cut, the exposed edge will be seen to be inhomogeneous, or in other words, having a gradient of fiber densities from one side through to the opposite side of the nonwoven. Single or multiple passes of mechanical compression while bonding may be used to produce nonwoven fabric that has sidedness, for example by differing the heating for thermal bonding on each side, along with using differing fibers diameters for each side, and/or by thermal compression bonding a nonwoven that was carded with different groups of fiber types on each side. Sidedness can also be accomplished by using different fiber thicknesses brought together in layers that look much like a laminating process, and allowing the heat/powder adhesive for thermal or powder/thermal bonding to bond the thinner more closely webbed fibers more densely and the thicker less closely webbed fibers lighter and loftier. Laminated as a term used herein should be construed to mean fiber webs that were separately carded brought together to form a single nonwoven. The term laminated should not be construed to mean the gluing to together of layers of material such as gluing or otherwise bonding together a polyurethane scrubbing layer onto a cellulose sponge. Although nonwovens may be constructed by laminating together two or more carded webs of fibers, the net result is a thicker nonwoven wherein it is difficult to discern layers. Depending on how a multi-layered nonwoven is finished (for example, the degree of thermal or chemical/thermal bonding of the fibers), the net resulting laminated nonwoven may appear to be a single layer of fibers. But when looking at a cross section of such a preferred nonwoven, the gradient of density may be visible, even without discerning a discrete transition between the original carded webs.

Nonwoven webs have been formed from many processes, for example, melt-blown, spun-bonded or spun-laid, toe-opened, wet-laid, air-laid, carded, and high pressure hydro-entangled. A preferred nonwoven for use as the substrate for the articles of the present invention are carded thermal bonded, or carded powder/thermal bonded nonwovens, for example, those available from HDK Industries, Inc.

These most preferred substrates have a "non-uniform cross-section" at least somewhere along the nonwoven. For example, the nonwoven may be uniform across its length and width (for example, viewing the top or the bottom surfaces of the substrate), yet still have non-uniform cross-section through its thickness (i.e., when viewing the edge of the substrate either as made or when cut through a cross-section). Additionally, nonwovens may be layered and in ways where the top layer does not fully cover the bottom layer and an asymmetrical fabric is produced that has part of its width as a single density fabric and an adjacent part of its width as a gradient of fiber densities. These nonwovens have a non-uniform cross-section somewhere on the fabric.

Preferred materials for nonwoven substrates comprise polyesters or polyamides. If a nonwoven substrate comprises polyamide, the polyamide may also function as "dye catcher" by adsorbing dyes released drying the washing cycle.

Additionally, it may be preferred that the substrate comprises an antimicrobial active agent such as silver or a silver compound such as SILVERPLUS® (available from Rudolf Chemie).

The dimensions of the sheet cut for the substrate in the article of the present invention should be suitable for easy handling, for example in the range of from about 10 cm×10 cm to about 20 cm×20 cm, however sheets of other dimensions may be useful when organized in convenient packaging for the consumer. Of course the sheet does not need to be square or really any particular shape, and any shape such as rectangular, polyhedral, rhomboidal, round, oval, heart- or other decorative-shape, even shaped in a way to identify a particular brand (such as the shape of a letter or word or trademark), will work within the present invention. The substrate for use in the present invention may be colored in any color (vivid colors for example), or may be substantially white, and may be textured from heated rollers that are patterned. The sheets may be rolled up or folded or otherwise intricately compacted in order to fit some unique packaging designs, or may be simply stacked like stiff cards into a suitable carton for merchandising. Also, the aesthetics of the sheet should be pleasing enough so that consumers will want to use it with their laundry chores. Thus, each of the separate composition zones should be individually recognizable to the consumer, for example through color, transparency, gloss, texture, fragrance, or any combinations of these attributes. For example, a sheet within the present invention may have a deep blue detergent zone and an opaque enzyme-containing zone, or perhaps a detergent region that has colored particles embedded within the zone.

It is preferred that in an article comprising at least two composition zones that the enzyme-containing composition zone geographically covers 2-30% of the total surface area of the article while the detergent composition zone covers 70-98% of the total surface area of the article. It may also be preferred that the surface of the article is not completely covered with composition-containing zones.

It may be preferred that the at least two composition zones be entirely separate from each other. It may also be preferred that the enzyme-containing zone is placed on top of the detergent composition zone and, thus, at least partially covers the detergent composition.

If a further fabric conditioning composition zone is present, it is preferred that the detergent composition zone and the enzyme-containing composition zone are completely soluble in water while the fabric conditioning composition zone is more than 80% retained (stable) through a standard wash cycle.

The water-insoluble substrate for the laundry article of the present invention may be impregnated with a detergent composition and an enzyme-containing composition through any suitable processing step, for example a simple spray coating of the nonwoven substrate with a heated molten mixture or an aqueous solution to even dipping of the nonwoven substrate into various mixtures. For example, the molten compositions may be sputter-sprayed from guns with heated nozzles much in the same way that heavy paints, glues and coatings and the like are sprayed onto wide surfaces in many other industries. The impregnation of each composition on the substrate may be conducted either at the same time (in a simultaneous process with parallel feeders or sprayers for example) or in separate operations that are perhaps sequential operations of the same process or separate combinations of different processes. Impregnations may be applied on one side of the substrate, or one or more impregnations (for example the detergent formulation) can be applied on one side, and the other composition (for example the fabric conditioning formulation) may be applied on the other side of the substrate. This is a particularly important option for when a substrate having dissimilar sides is used. A suitable process for impregnation is for example a slot-coating process or a Gravure-coating process.

The form of any of the compositions applied to the substrate may be anything from thin to thick liquid, to slurry or paste, to molten materials that solidify into waxy appearing coatings upon cooling. It is simpler and preferable to apply both the detergent compositions and the enzyme-containing compositions as molten mixtures, even though the detergent compositions may be applied as aqueous solutions or slurries in a spray or dipping operation with a subsequent drying step to remove the excess water from the substrate.

Specific, but non-limiting embodiments of the laundry article of the present invention are delineated in the tables below.

Table 1 shows combinations of the detergent ingredients described above to produce detergent compositions suitable for application to the substrate.

The compositions D1 to D5 listed in Table 1 are heated co-melts and the amounts (amounts of actives in weight percent (wt. %)) shown are also the amounts on the substrate since any water in the composition tends to stay within the waxy zone.

TABLE 1

Example detergent compositions for application to a substrate

| Ingredients | Weight Percent (actives %) | | | | |
|---|---|---|---|---|---|
| | D1 | D2 | D3 | D4 | D5 |
| Sodium dodecyl benzene sulfonate | 26.09 | 17.30 | 15.60 | 17.70 | 27.00 |
| Sodium alkyl $C_{14}$-$C_{15}$/7EO ether sulfate | 13.80 | — | — | — | 14.00 |
| Linear alcohol ethoxylate $C_{14}$-$C_{15}$/7EO | 13.44 | 5.40 | 14.60 | 5.50 | 14.00 |
| Linear alcohol ethoxylate $C_{12}$-$C_{20}$/7EO | — | — | — | — | 23.00 |
| Polyethylene Glycol PEG-75 | 2.00 | 1.40 | 1.30 | 1.40 | 2.00 |
| Polyoxyethylene (100) stearyl ether | 21.99 | 15.60 | 14.10 | 15.90 | — |
| Sodium Silicate $SiO_2/Na_2O$ ratio 1.6-1.8 | 3.72 | 16.60 | 15.00 | 17.00 | — |
| Sodium Silicate (Britesil ® C24) | 7.00 | — | — | — | 11.00 |
| Sodium Carbonate | — | 6.50 | 5.90 | 6.70 | — |
| Sodium tetraborate decahydrate | — | 11.90 | 10.80 | 12.20 | — |
| Sodium polyacrylate ~4,500 MW | — | 1.80 | 1.70 | — | — |
| EDTA—tetrasodium salt | — | 0.10 | 0.10 | 0.10 | — |
| Optical brightener (Tinopal ® CBS-X) | 0.15 | 0.10 | 0.09 | 0.10 | 0.20 |
| Dyes and fragrances | 0.90 | 0.90 | 0.81 | 1.01 | 0.35 |
| Water | 10.92 | 22.10 | 19.90 | 22.40 | 9.55 |

Table 2 shows combinations of the ingredients described above to enzyme-containing compositions suitable for application to the substrates.

TABLE 2

Example enzyme-containing compositions for application to a substrate

| Ingredients | Weight Percent (actives %) | | | | |
|---|---|---|---|---|---|
| | E1 | E2 | E3 | E4 | E5 |
| Polyethylene Glycol PEG-75 | 98.60 | 99.10 | — | — | — |
| Fatty acid based matrix 1 | — | — | 98.91 | — | 99.10 |
| Fatty acid based matrix 2 | — | — | — | 98.80 | — |
| Protease | 0.10 | 0.10 | 0.12 | 0.10 | 0.10 |
| Mannanase | 0.02 | — | 0.02 | 0.02 | — |
| Amylase | 0.12 | 0.25 | 0.1 | 0.12 | 0.25 |
| Cellulase | 0.08 | — | 0.1 | 0.08 | — |
| Lipase | 0.08 | — | — | 0.08 | — |
| Pectate lyase | — | — | — | 0.05 | — |
| Enzyme stabilizers | 1.00 | 0.55 | 0.75 | 0.75 | 0.55 |
| Melting point (° C.) | 40° C. | 45° C. | 45° C. | 45° C. | 50° C. |

Fatty acid based matrix 1 is comprised of 20 wt. % of the sodium salt of coconut fatty acid, 50 wt. % of nonpolymeric polyols (sorbitol, glycerin, propylene glycol, sucrose and glucose), 15 wt. % of anionic and nonionic surfactants, and 15 wt. % of water.

Fatty acid based matrix 2 is comprised of 20 wt. % of the sodium salt of stearic acid, 3 wt. % of the sodium salt of lauric acid, 3 wt. % of the sodium salt of myristic acid, 50 wt. % of nonpolymeric polyols (sorbitol, glycerin, and propylene glycol), 2 wt. % of lauric acid, 2 wt. % of stearic acid, 10 wt. % of anionic surfactant, and 10 wt. % of water.

TABLE 3

Laundry Article Examples

| Ingredients | Weight composition (g) of compositions loaded on the particular substrate indicated | | | | |
|---|---|---|---|---|---|
| | A | B | C | D | E |
| Detergent composition | D5 (8 g) | D5 (8 g) | D5 (8 g) | D5 (8 g) | D5 (8 g) |
| Enzyme-containing composition | E1 (3.9 g) | E2 (3.2 g) | E3 (3.9 g) | E4 (3.9 g) | E5 (3.2 g) |
| Nonwoven* | PES | PES | PES | PES | PES |

*non-woven polyester fiber from HDK Industries

Laundry articles A to E were stored at 30° C. for eight weeks and afterwards the laundry articles were subjected to standard wash cycle using a top loader washing machine or a front loader washing, each being loaded with 3.5 kg of fabrics comprised of different materials (polyester, polyester/cotton, polyamide/elasthane, polyamide/Micro Modal/elasthane, and viscose). The fabrics had been soiled with 92 different stains that comprised bleachable, enzyme-specific and fat-pigment-cosmetic stains.

All laundry articles A to E showed improved performance especially with regard to the enzyme-specific stains. These results show that the enzyme-containing does not only effectively release the enzymes in the washing liquor but that the enzymes can be stably coated onto the laundry article. No or only little deterioration of the enzyme activity occurs during manufacture and during storage of the laundry article according to the present invention.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A laundry article used for cleaning fabrics comprising:

a. a water-insoluble nonwoven substrate;

b. a detergent composition solidified on the substrate in a first zone; and, c. an enzyme-containing composition solidified on the substrate in a second zone that is geographically different than the first zone, wherein the enzyme-containing composition comprises an enzyme embedded in a matrix and wherein the matrix is composed of fatty acids, fatty acid soaps, polyols or mixtures thereof, wherein the matrix is at a level from 85% by weight to 99.9% by weight of the enzyme-containing composition.

2. The article of claim 1, wherein the matrix is at a level from 85% by weight to 99.5% by weight of the enzyme-containing composition.

3. The article of claim 1, wherein the enzyme is at a level from 0.1% by weight to 50% by weight of the enzyme-containing composition.

4. The article of claim 1, wherein the enzyme-containing composition additionally comprises an enzyme stabilizer.

5. The article of claim 1, wherein the enzyme is selected from the group consisting of proteases, lipases, amylases, cellulases, cutinases, oxidases, peroxidases, mannanases, tannases, perhydrolases, laccases, and mixtures thereof.

6. The article of claim 1, wherein the fatty acid is selected from the group consisting of caprylic acid, capric acid, lauric acid, myristic acid, palmitic acid, stearic acid, erucaic acid, hydrogenated erucaic acid, linoleic acid, linolenic acid, oleic acid, behenic acid, hydrogenated behenic acid, coconut fatty acid, palm kernel fatty acid, olive oil fatty acid, and tallow fatty acid.

7. The article of claim 1, wherein the fatty acid soap is selected from the group consisting of metal salts and ammonium salts of caprylic acid, capric acid, lauric acid, myristic acid, palmitic acid, stearic acid, erucaic acid, hydrogenated erucaic acid, linoleic acid, linolenic acid, oleic acid, behenic acid, hydrogenated behenic acid, coconut fatty acid, palm kernel fatty acid, olive oil fatty acid, and tallow fatty acid.

8. The article of claim 1, wherein the polyol is selected from the group consisting of polyethylene glycol, polypropylene glycol, glycerin, sucrose, propylene glycol, sorbitol, glucose and mixtures thereof.

9. A method of producing a laundry article used for cleaning fabrics comprising a water-insoluble nonwoven substrate, a detergent composition and an enzyme-containing composition, the method comprising:

a. melting a detergent composition;

b. melting a matrix material selected from the group consisting of fatty acids, fatty acid soaps, polyols and mixtures thereof;

c. adding a liquid formulation comprising an enzyme to the molten matrix material to form an enzyme-containing composition, wherein the matrix material is at a level from 85% by weight to 99.9% by weight of the enzyme-containing composition;

d. supplying a length of nonwoven substrate; and e. coating said substrate with the molten detergent composition in a first zone and the molten enzyme-containing composition in a second zone that is geographically different than the first zone and allowing the resulting detergent and enzyme-containing compositions to cool and solidify on the substrate.

10. A method of washing fabrics comprising:

a. supplying the laundry article of claim 1; and b. washing a load of fabrics in a laundry machine with said article.

* * * * *